US011419478B2

(12) United States Patent
Cordaro et al.

(10) Patent No.: US 11,419,478 B2
(45) Date of Patent: Aug. 23, 2022

(54) METHOD AND APPARATUS FOR SENSING DRYNESS ACCORDING TO AIR QUALITY

(71) Applicant: Haier US Appliance Solutions, Inc., Wilmington, DE (US)

(72) Inventors: Rocco Cordaro, Louisville, KY (US); Stannard Nathan Phelps, Louisville, KY (US); Kyle Joseph Brandewie, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 50 days.

(21) Appl. No.: 16/928,671

(22) Filed: Jul. 14, 2020

(65) Prior Publication Data

US 2022/0015601 A1 Jan. 20, 2022

(51) Int. Cl.

| | |
|---|---|
| ***A47L 15/46*** | (2006.01) |
| ***A47L 15/00*** | (2006.01) |
| ***A47L 15/23*** | (2006.01) |
| ***A47L 15/48*** | (2006.01) |

(52) U.S. Cl.

CPC ..... *A47L 15/46* (2013.01); *A47L 15/0013* (2013.01); *A47L 15/0028* (2013.01); *A47L 15/0034* (2013.01); *A47L 15/0044* (2013.01); *A47L 15/23* (2013.01); *A47L 15/488* (2013.01); *A47L 2401/19* (2013.01); *A47L 2401/20* (2013.01); *A47L 2501/11* (2013.01); *A47L 2501/12* (2013.01); *A47L 2501/30* (2013.01); *A47L 2501/32* (2013.01)

(58) Field of Classification Search

CPC .. A47L 15/13; A47L 15/34; A47L 15/48–488; A47L 15/0013; A47L 15/0034

See application file for complete search history.

(56) References Cited

U.S. PATENT DOCUMENTS

| | | | | |
|---|---|---|---|---|
| 2003/0213505 | A1 | 11/2003 | Ballas | |
| 2019/0045998 | A1 | 2/2019 | Calvimontes | |
| 2021/0353125 | A1* | 11/2021 | Park | A47L 15/4287 |
| 2022/0002932 | A1* | 1/2022 | Kessler | A47L 15/0034 |

FOREIGN PATENT DOCUMENTS

| | | |
|---|---|---|
| CN | 104603349 B | 12/2016 |
| CN | 106361238 A | 2/2017 |

* cited by examiner

*Primary Examiner* — Spencer E. Bell

(74) *Attorney, Agent, or Firm* — Dority & Manning, P.A.

(57) ABSTRACT

A dishwasher includes a tub defining a wash chamber, a wash rack provided within the wash chamber, an air inlet in fluid communication with the wash chamber at a first position, an air exhaust outlet in fluid communication with the wash chamber at a second position different from the first position, a first gas sensor provided in the dishwasher, and a controller configured to initiate an operation sequence. The operation sequence includes initiating a drying cycle, receiving an air-quality signal from the first gas sensor, measuring, during the drying cycle, an air-quality characteristic within the wash chamber of the dishwasher, determining the measured air-quality characteristic is below a predetermined air-quality threshold, calculating a drying time in response to determining the measured air-quality characteristic is below the predetermined air-quality threshold, and halting the drying cycle in response to an expiration of the drying time.

9 Claims, 4 Drawing Sheets

METHOD AND APPARATUS FOR SENSING DRYNESS ACCORDING TO AIR QUALITY

FIELD OF THE INVENTION

The present subject matter relates generally to dishwashers, and more particularly to sensing air quality and determining dryness levels in dishwashers.

BACKGROUND OF THE INVENTION

Dishwasher appliances generally perform washing operations including a wash cycle, a rinse cycle, and a dry cycle. The wash and rinse cycles supply specified quantities of water into a wash chamber to remove debris and food stuffs from dishes such as plates, bowls, glassware, utensils, and the like. Each of the wash and rinse cycles may leave water droplets on the dishes. In some dishwasher appliances, a dry cycle may be performed in which heated air is circulated through the wash chamber to remove the water droplets. Conventional dry cycles run for a predetermined amount of time that is stored in a controller of the dishwasher appliance.

These conventional dry cycles have drawbacks. For example, because the dry cycle is set to run only for a predetermined amount of time, the dishes within the wash chamber may not get completely dry (i.e., water droplets remain on the dishes after a completion of the dry cycle). Alternatively, when a relatively small load is in the wash chamber, the dishes may dry more quickly and thus energy is wasted by running the dry cycle for the entire predetermined amount of time.

Accordingly, a dishwasher with an improved dry cycle would be useful. In addition, a method of drying dishes that solves one or more of the above problems would be useful. Particularly, a method of drying dishes that reduces a drying time and increases a user's confidence in dry dishes would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method for operating a dishwasher is provided. The method may include initiating a washing cycle; initiating a drying cycle; measuring, during the drying cycle, an air-quality characteristic within a wash tub of the dishwasher; determining the measured air-quality characteristic is below a predetermined air-quality threshold; calculating a drying time in response to determining the measured air-quality characteristic is below the predetermined air-quality threshold; and halting the drying cycle in response to an expiration of the drying time.

In another exemplary aspect of the present disclosure, a dishwasher is provided. The dishwasher may include a tub defining a wash chamber, a wash rack provided within the wash chamber, an air inlet in fluid communication with the wash chamber at a first position, an air exhaust outlet in fluid communication with the wash chamber at a second position different from the first position, a first gas sensor provided in the dishwasher, and a controller configured to initiate an operation sequence. The operation sequence may include initiating a drying cycle, receiving an air-quality signal from the first gas sensor, measuring, during the drying cycle, an air-quality characteristic within the wash chamber of the dishwasher, determining the measured air-quality characteristic is below a predetermined air-quality threshold, calculating a drying time in response to determining the measured air-quality characteristic is below the predetermined air-quality threshold, and halting the drying cycle in response to an expiration of the drying time.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
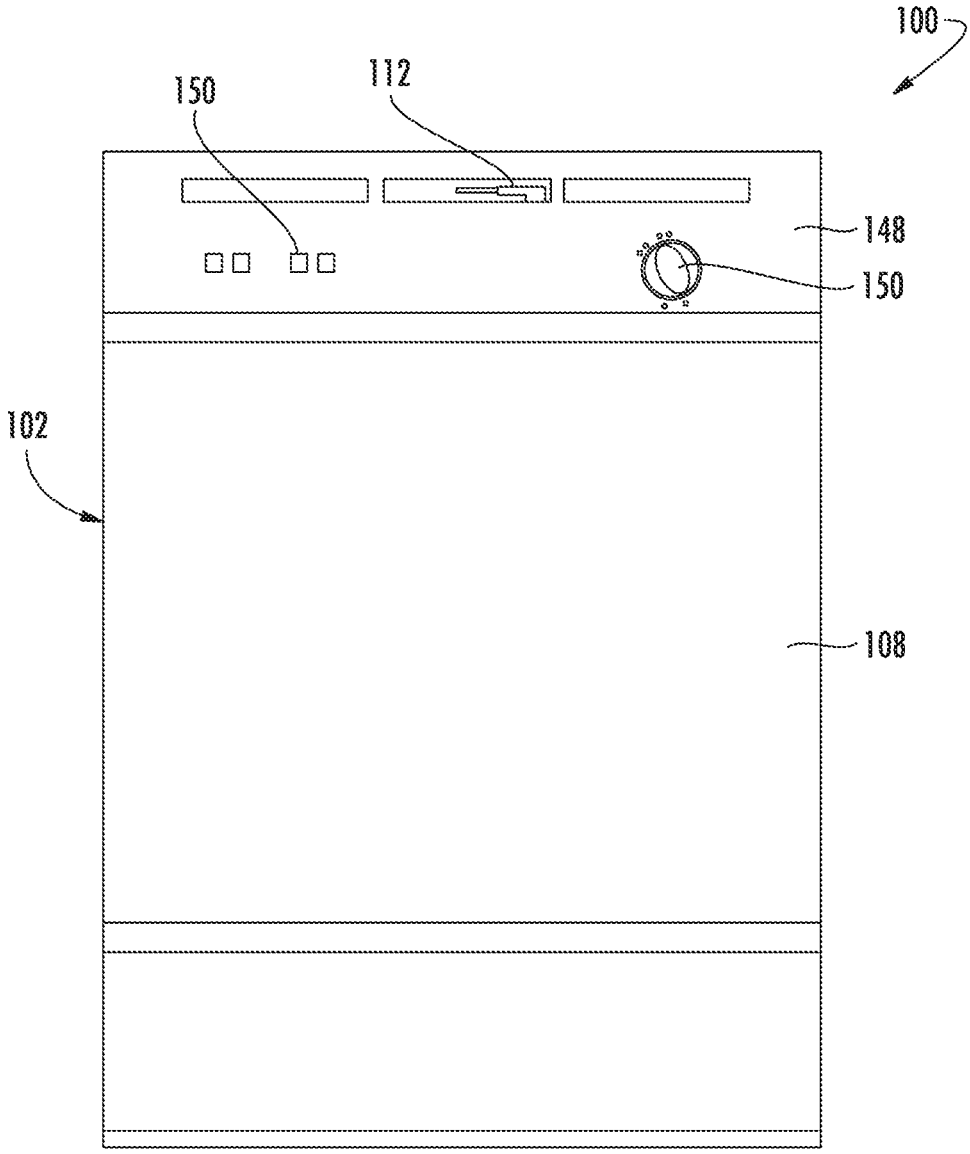
FIG. 1 provides a front view of a dishwasher appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
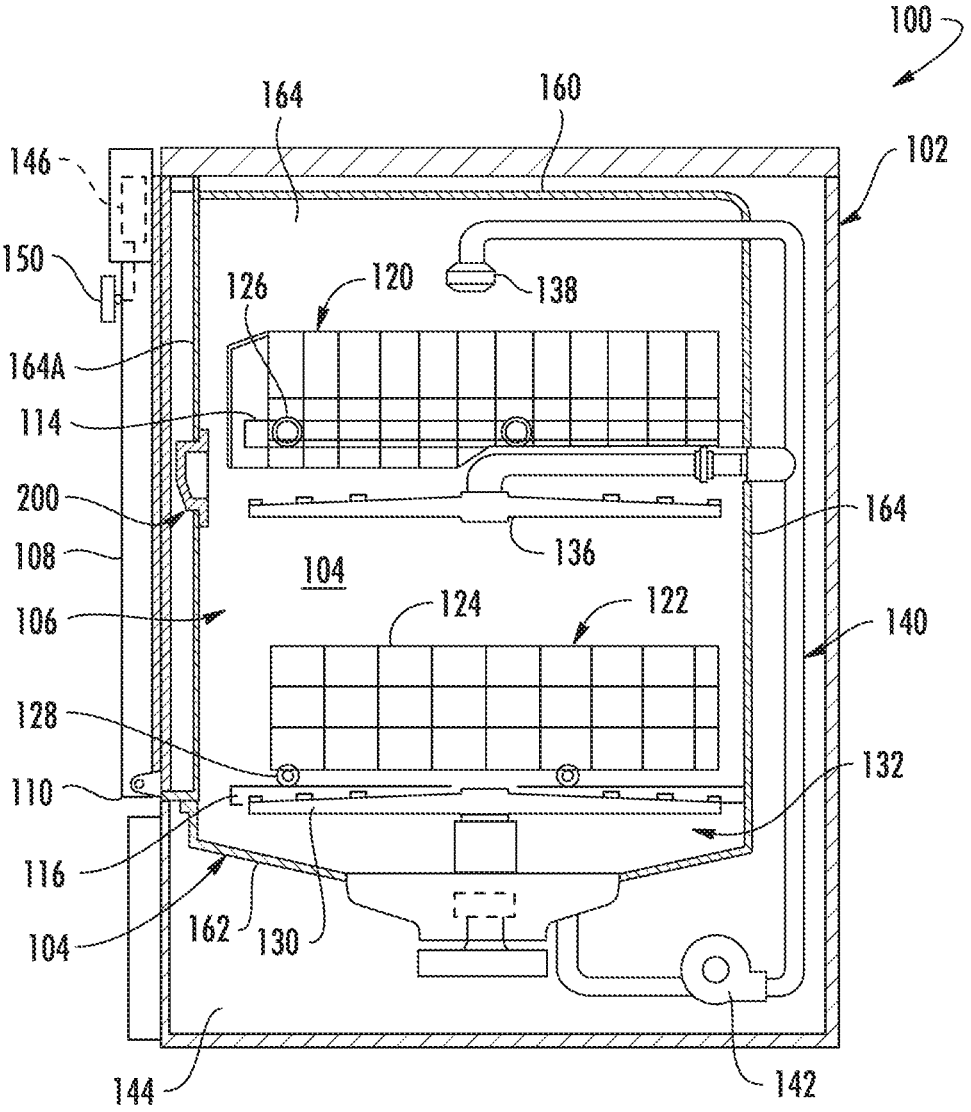
FIG. 2 provides a section side view of the exemplary dishwasher appliance of FIG. 1.

Referring now to the drawings, FIGS. 1 and 2 illustrate an exemplary embodiment of a dishwasher appliance 100 that may be configured in accordance with aspects of the present disclosure. As shown in the illustrated exemplary embodiment, dishwasher appliance or dishwasher 100 may include a cabinet 102 having a tub 104 therein defining a wash chamber 106. Tub 104 may generally include a front opening (not shown) and a door 108 hinged at its bottom 110 for movement between a normally closed vertical position (shown in FIGS. 1 and 2), wherein wash chamber 106 is sealed shut for washing operation, and a horizontal open position for loading and unloading of articles from dishwasher 100. As shown in FIG. 1, a latch 112 may be used to lock and unlock door 108 for access to wash chamber 106.

Figure 3:
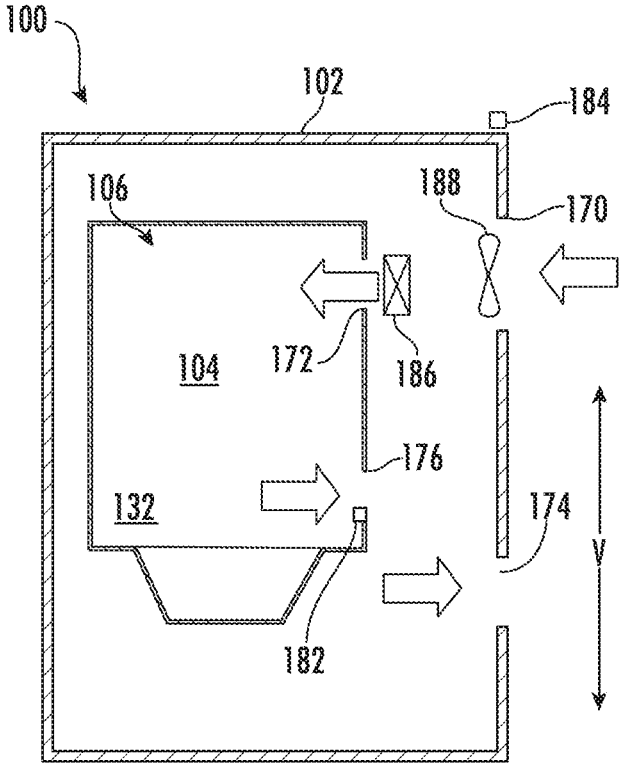
FIG. 3 provides a section side view of the exemplary dishwasher appliance of FIG. 1

As is understood, tub 104 may generally have a rectangular cross-section defined by various wall panels or walls. For example, as shown in FIG. 2, tub 104 may include a top wall 160 and a bottom wall 162 spaced apart from one another along a vertical direction V of dishwasher 100. Additionally, tub 104 may include a plurality of sidewalls 164 (e.g., four sidewalls) extending between the top and bottom walls 160 and 162. As shown in FIG. 3, a front sidewall 164A of tub 104 may generally define the inner wall or inner surface of door 108. It should be appreciated that tub 104 may generally be formed from any suitable material. However, in several embodiments, tub 104 may be formed from a ferritic material, such as stainless steel, or a polymeric material.

As particularly shown in FIG. 2, upper and lower guide rails 114, 116 may be mounted on opposing side walls 164 of tub 104 and may be configured to accommodate roller-equipped rack assemblies 120 and 122. Each of rack assemblies 120 and 122 may be fabricated into lattice structures including a plurality of elongated members 124 (for clarity of illustration, not all elongated members making up assemblies 120 and 122 are shown in FIG. 2). Additionally, each rack 120 and 122 may be adapted for movement between an extended loading position (not shown) in which the rack is substantially positioned outside wash chamber 106, and a retracted position (shown in FIGS. 1 and 2) in which rack is located inside wash chamber 106. This may be facilitated by rollers 126 and 128, for example, mounted onto racks 120 and 122, respectively. As is generally understood, a silverware basket (not shown) may be removably attached to rack assembly 122 for placement of silverware, utensils, and the like, that are otherwise too small to be accommodated by racks 120 and 122.

Additionally or alternatively, dishwasher 100 may also include a lower spray-arm assembly 130 that is configured to be rotatably mounted within a lower region 132 of wash chamber 106 directly above bottom wall 162 of tub 104 so as to rotate in relatively close proximity to rack assembly 122. As shown in FIG. 2, a mid-level spray-arm assembly 136 may be located in an upper region of wash chamber 106, such as by being located in close proximity to upper rack 120. Moreover, an upper spray assembly 138 may be located above upper rack 120.

As is generally understood, lower and mid-level spray-arm assemblies 130 and 136 and upper spray assembly 138 may generally form part of a fluid circulation system 140 for circulating fluid (e.g., water and dishwasher fluid) within the tub 104. As shown in FIG. 2, fluid circulation system 140 may also include a pump 142 located in a machinery compartment 144 below bottom wall 162 of tub 104, as is generally recognized in the art. Moreover, each spray-arm assembly 130 and 136 may include an arrangement of discharge ports or orifices for directing washing liquid onto dishes or other articles located in rack assemblies 120 and 122, which may provide a rotational force by virtue of washing fluid flowing through the discharge ports. The resultant rotation of lower spray-arm assembly 130 provides coverage of dishes and other dishwasher contents with a washing spray.

Dishwasher 100 may be further equipped with a controller 146 configured to regulate operation of dishwasher appliance 100. Controller 146 may generally include one or more memory devices and one or more microprocessors, such as one or more general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

Controller 146 may be positioned in a variety of locations throughout dishwasher 100. In the illustrated embodiment, controller 146 is located within a control panel area 148 of door 108, as shown in FIG. 1. In such an embodiment, input/output ("I/O") signals may be routed between the control system and various operational components of dishwasher appliance 100 along wiring harnesses that may be routed through bottom 110 of door 108. Typically, controller 146 includes a user interface panel/controls 150 through which a user may select various operational features and modes and monitor progress of dishwasher 100. In one embodiment, user interface 150 may represent a general purpose I/O ("GPIO") device or functional block. Additionally, user interface 150 may include input components, such as one or more of a variety of electrical, mechanical or electro-mechanical input devices including rotary dials, push buttons, and touch pads. User interface 150 may also include a display component, such as a digital or analog display device designed to provide operational feedback to a user. As is generally understood, user interface 150 may be in communication with controller 146 via one or more signal lines or shared communication busses.

It should be appreciated that the present subject matter is not limited to any particular style, model, or configuration of dishwasher appliance. The exemplary embodiment depicted in FIGS. 1 and 2 is simply provided for illustrative purposes only. For example, different locations may be provided for user interface 150, different configurations may be provided for racks 120 and 122, and other differences may be applied as well.

Turning now to FIG. 3, a side sectional view of an exemplary dishwasher 100 is shown. The cabinet 102 may include an air inlet 170. The air inlet 170 may allow eternal (e.g., ambient) air to enter the cabinet 102. The air inlet 170 may be a hole or passageway provided at the cabinet 102. In some embodiments, the air inlet 170 may include a hose or duct. The hose or duct may connect the cabinet 102 with an area or region outside of a building (e.g., house, apartment, etc.). The air inlet 170 may be provided in any suitable location on the cabinet 102. For example, the air inlet 170 is provided at or near a top of a rear panel of cabinet 102. However, air inlet 170 may be located at another area of the rear panel, or on a different side panel or top panel of the cabinet 102.

The cabinet 102 may include an air outlet 174. The air outlet 174 may allow internal air (e.g., air within the cabinet 102) to exit the cabinet 102. The air outlet 174 may be a hole or passageway provided at the cabinet 102. In some embodiments, the air outlet 174 may include a hose or duct. The hose or duct may connect the cabinet 102 with an outside of a building (e.g., house, apartment, etc.). The air outlet 174 may be provided in any suitable location on the cabinet 102. For example, the air outlet 174 is provided at or near a bottom of a rear panel of cabinet 102. However, air outlet 174 may be located at another area of the rear panel, or on a different side panel or top panel of the cabinet 102.

The tub 104 may include an air inlet 172 in fluid communication (e.g., upstream communication) with the wash chamber 176. When assembled, the air inlet 172 may allow the external (e.g., ambient) air that has entered the cabinet 102 through air inlet 170 to circulate through the wash chamber 106. The air inlet 172 may be provided adjacent to the air inlet 170 of the cabinet 102. In other words, air that enters the cabinet via air inlet 170 may then enter wash chamber 106 through air inlet 172. A hose or duct may connect air inlet 172 to air inlet 170 to provide a direct passage for air to enter wash chamber 106 from an exterior of chamber 102. Thus, air inlet 172 of the tub 104 may be provided at a location separate from air inlet 170 of the cabinet 102. Air inlet 172 may be a hole or passageway provided in a sidewall 164 of tub 104.

The tub 104 may include an air exhaust outlet 176 in fluid communication (e.g., downstream communication) with the wash chamber 106. When assembled, the air exhaust outlet 176 may allow the internal air (e.g., air within the wash chamber 106) that has entered the tub 104 through air inlet 172 to exit the wash chamber 106. The air exhaust outlet 176 may be provided adjacent to the air outlet 174 of the cabinet 102. In other words, air that exits the wash chamber 106 via air exhaust outlet 176 may then exit cabinet 102 through air outlet 174. A hose or duct may connect air exhaust outlet 176 to air outlet 174 to provide a direct passage for air to exit wash chamber 106 and chamber 102. Thus, air exhaust outlet 176 of the tub 104 may be provided at a location separate from air outlet 174 of the cabinet 102. Air exhaust outlet 176 may be a hole or passageway provided in a sidewall 164 of tub 104.

The dishwasher 100 may further include a gas sensor 180 (e.g., in electrical or wireless communication with controller 146). During use, the gas sensor 180 may communicate with the controller 146 to send information to the controller 146. Generally, gas sensor 180 is configured to detect an air-quality characteristic (e.g., within wash chamber 106). Thus, the gas sensor 180 may sense an air-quality characteristic within the wash chamber 106. The gas sensor 180 may be located at any appropriate location within the dishwasher 100. For example, the gas sensor 180 is provided within the wash chamber 106. In one embodiment, the gas sensor 180 is provided at the air exhaust outlet 176 of the tub 104 (e.g., downstream from the wash chamber 106). Additionally or alternatively, the gas sensor 180 may be located within a separate housing provided within the wash chamber 106 or the air exhaust outlet. 176. For another example, the gas sensor 180 may be provided within a housing located in the air exhaust outlet 176.

The gas sensor 180 may sense the air-quality characteristic within the wash chamber 106 after a washing cycle, during a drying cycle, or after a drying cycle. The air-quality characteristic may be total volatile organic compounds (tVOC) or equivalent carbon dioxide ($eCO_2$), for example. The gas sensor 180 may be configured to measure any suitable air-quality characteristic, and the disclosure is not limited to those mentioned herein. Additionally or alternatively, a plurality of gas sensors 180 may be provided to measure multiple air-quality characteristics.

In an exemplary embodiment, the gas sensor 180 includes a first gas sensor 182 provided at the air exhaust outlet 176 of the tub 104 and a second gas sensor 184 adjacent to the first gas sensor 182. The first gas sensor 182 may measure tVOC levels. The second gas sensor 184 may measure $eCO_2$ levels. The first gas sensor 182 and the second gas sensor 184 may operate simultaneously or in tandem. Alternatively, only one of the first gas sensor 182 and the second gas sensor 184 may be operational during a drying cycle.

In another exemplary embodiment, the gas sensor 180 includes the first gas sensor 182 and the second gas sensor 184. The first gas sensor 182 may be provided at the air exhaust outlet 176 of the tub 104 (e.g., downstream from the wash chamber 106 within the cabinet 102). The second gas sensor 184 may be provided outside of the wash chamber 104. In detail, the second gas sensor 184 may be provided outside of the dishwasher 100 (e.g., outside of the cabinet 102). For example, the second gas sensor 184 may be mounted to an external surface of the cabinet 102 and may be in fluid communication with the ambient environment (e.g., air outside of the wash chamber 106). The first gas sensor 182 and the second gas sensor 184 may sense the same air-quality characteristic (e.g., tVOC or $eCO_2$). The first gas sensor 182 may measure the air-quality characteristic within the wash chamber 106. The second gas sensor may measure the air-quality characteristic in the ambient environment (e.g., the air-quality characteristic outside of the wash chamber 106). The second gas sensor 184 may send the measured air-quality characteristic of the ambient environment to the controller 146. The controller 146 may then use the ambient air-quality characteristic when analyzing the air-quality characteristic measured by the first gas sensor 182. For example, the controller 146 may compare the air-quality characteristic within the wash chamber 106 with the air-quality characteristic in the ambient environment, using the air-quality characteristic in the ambient environment as a baseline measurement. In other words, the as the air-quality characteristic of the ambient environment changes (e.g., with the presence of pet dander or allergens), the controller 146 may adjust a threshold air-quality characteristic against which the air-quality characteristic within the wash chamber 106 is compared.

The dishwasher 100 may further include a heating unit 186. The heating unit 186 may be provided within the cabinet 102. In an exemplary embodiment, the heating unit 186 is provided at the air inlet 172 of the tub 104 (e.g., upstream from the wash chamber 106). Additionally or alternatively, the heating unit 186 may be provided at the air inlet 170 to the cabinet 102 (e.g., in fluid communication between the air inlet 170 and the air inlet 172). For instance, the heating unit 186 may be positioned along an air flow path from the air inlet 170 to the air inlet 172 such that the air supplied to the tub 104 may be heated. The heating unit 186 may be any suitable heating unit, such as a coil heater, a resistance heater, a radiant heater, or the like. The heating unit 186 may communicate with the controller 146. The controller 146 may selectively activate the heating unit 186 according to an analysis of the air-quality characteristic measured within the wash chamber 106, as will be described below.

The dishwasher 100 may further include a fan 188. The fan 188 may be provided within the cabinet 102. In an exemplary embodiment, the fan 188 is provided at the air inlet 170 of the cabinet 102 (e.g., upstream from the wash chamber 106). The fan 188 may be adjacent to the heating unit 186 such that air circulated by the fan 188 passes over the heating unit 186 before entering the wash chamber 106. For example, the fan 188 may be provided upstream from the heating unit 186. Alternatively, the fan 188 may be provided downstream from the heating unit 186. The fan 188 may be any suitable fan configured to circulate a flow of air. For example, the fan 188 may be an axial fan, a centrifugal fan, or a cross-flow fan. The controller 146 may control an initiation of the fan 188 according to an analysis of the air-quality characteristic within the wash chamber 106.

In some embodiments, the dishwasher 100 may include one or more other sensors in electrical or wireless communication with the controller 146. For example, a humidity sensor may be provided within the cabinet 102 or the tub 104. Additionally or alternatively, a temperature sensor may be provided within the cabinet 102 or the tub 104. The humidity sensor may provide a humidity measurement and the temperature sensor may provide a temperature measurement within the tub 104 to the controller 146. These measurements may be used in conjunction with the measurements taken by the gas sensor 180 to analyze a dryness level of the dishes within the tub 104. Advantageously, a dishwasher in accordance with the present disclosure or methods may detect a level of dryness within a wash chamber to increase user confidence, improve consistency of performance, or decrease energy usage.

Figure 4:
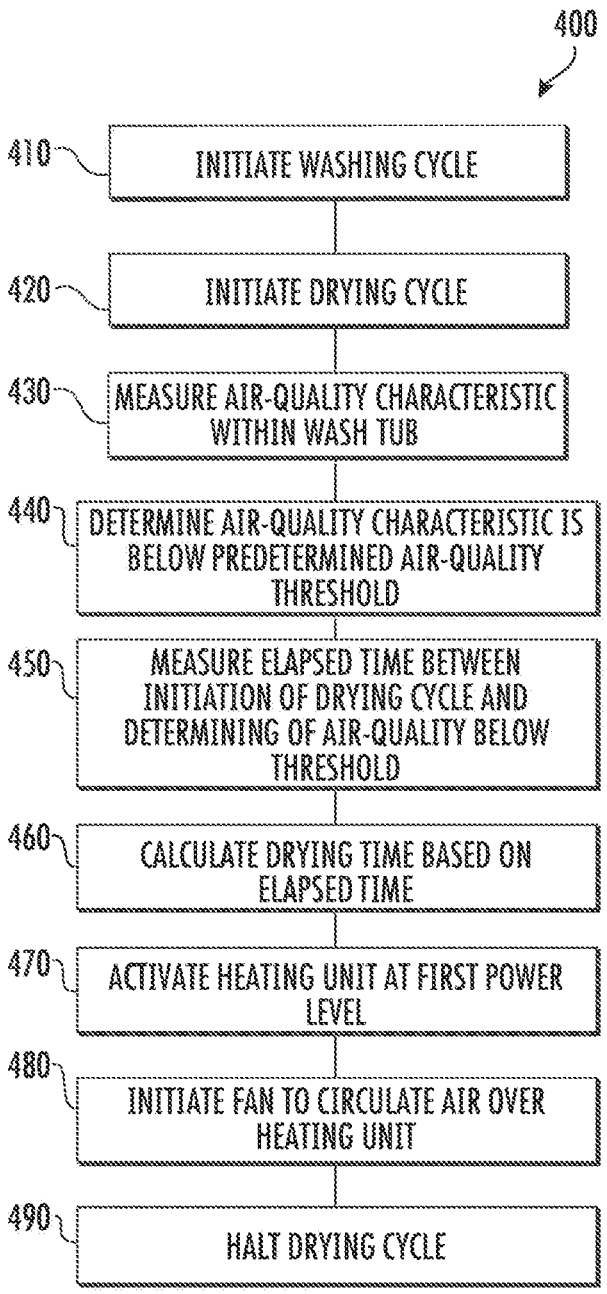
FIG. 4 provides a flow chart illustrating a method of operating a dishwasher.

Referring now to FIG. 4, a method 400 of operating a dishwasher (e.g., dishwasher 100) will be described in detail. At 410, the method 400 includes initiating a washing cycle. The washing cycle may be any suitable washing cycle. For example, the washing cycle may include spraying water and detergent through the spray-arms to clean dishes or articles stored in the wash chamber. Optionally, the washing cycle may include a rinsing cycle. The rinsing cycle may include spraying water through the spray-arms to rinse leftover detergent and foodstuffs off of the dishes.

At 420, the method 400 includes initiating a drying cycle. The drying cycle may include initiating the fan. The drying cycle may further include activating the heating unit (e.g., at a first power level). As such, the fan may circulate heated air through the wash chamber to accelerate a drying of the dishes. Alternatively or additionally, the drying cycle may include circulating air through the wash chamber without activating the heating unit. The drying cycle may be initiated after a completion of the washing cycle. For instance, 420 may be subsequent to or in response to the washing cycle.

At 430, the method 400 includes measuring an air-quality characteristic within the wash tub. 430 may be carried out during the drying cycle. For instance, 430 may be initiated at the same time as 420. In one embodiment, when the washing cycle is stopped, 420 and 430 are initiated at the same time (i.e., the drying cycle is initiated at the same time as the measuring of air-quality characteristic). In detail, the gas sensor (e.g., first gas sensor) may sense an air-quality characteristic within the wash chamber of the tub. As described above, the air-quality characteristic may be one of total volatile organic compounds (tVOC) and equivalent carbon dioxide ($eCO_2$), for example. The gas sensor may be configured to measure any suitable air-quality characteristic, and the disclosure is not limited to those mentioned herein. Additionally or alternatively, a plurality of gas sensors may be provided to measure multiple air-quality characteristics, as described above.

At 440, the method 400 includes determining that the air-quality characteristic measured at 430 is below a predetermined air-quality threshold. For instance, the controller may be configured to analyze the measurement of the air-quality characteristic measured by the gas sensor. The controller may compare the measurement to a characteristic threshold stored in the controller. Optionally, the characteristic threshold may be a predetermined threshold (e.g., programmed within the controller during assembly). In an exemplary embodiment, the predetermined threshold is five parts per billion (ppb) of tVOC.

In some embodiments, the characteristic threshold may vary according to one or more particular environmental factors (e.g., current atmosphere characteristics, presence of pollutants or allergens, etc.). Specifically, the characteristic threshold may be referred to as a normal threshold under normal atmospheric conditions (e.g., no predominant presence of pollutants, pet dander, or the like). Further, the normal threshold may be increased when certain atmospheric or ambient conditions are detected.

In an exemplary embodiment, a gas sensor (e.g., second gas sensor) may detect or measure an air-quality characteristic of the ambient environment (e.g., outside of the wash chamber or cabinet of the dishwasher, as described above). As an example, the second gas sensor may measure the presence of pet dander in the ambient environment. Accordingly, the controller may determine that a condition of dryness correlates to a higher air-quality characteristic reading than the normal threshold. For example, the presence of pet dander may alter a static measurement of air-quality (e.g., an air quality measurement that signals a dry atmosphere). The controller may then adjust the normal threshold to determine a condition of dryness. In one embodiment, the controller adjusts the normal threshold by a proportional factor according to an increase in the air-quality characteristic of the ambient environment. The increased air-quality threshold may be referred to as an abnormal threshold.

At 450, the method 400 includes measuring an elapsed time between the initiation of the drying cycle and the determination of the air-quality characteristic being below the air-quality threshold (e.g., the start of 410 and the completion of 440). In some such embodiments, the gas sensor begins sensing the air-quality characteristic within the wash tub upon (e.g., in response to) the initiation of the drying cycle. The controller may measure the elapsed time between when the gas sensor begins sensing the air-quality characteristic and when the air-quality characteristic falls below the predetermined threshold.

At 460, the method 400 includes calculating a drying time (e.g., remaining drying time) based on the elapsed time. The controller may then calculate a total time until the dishes are deemed to be dry. The remaining drying time may be a period of time from when the air-quality characteristic drops below the air-quality threshold to an end or completion of the drying cycle. For example, if the elapsed time is below a first predetermined time threshold, the controller may determine that a shorter drying time is required to dry the dishes completely. Alternatively, if the elapsed time is above the first predetermined time threshold, the controller may determine that a longer drying time is required to dry the dishes completely.

At 470, the method 400 includes activating the heating unit (e.g., at the first power level). Upon (e.g., in response to) calculating the remaining drying time, the controller may activate the heating unit. The heating unit may be activated at the first power level upon determining that the calculated remaining drying time is at the second predetermined time threshold. Additionally or alternatively, the calculated remaining drying time may be within a certain (e.g., programmed) percentage of the second predetermined time threshold to prompt the activation of the heating unit at the first power level. In some such embodiments, 470 includes determining the calculated remaining drying time at 460 is within the programmed percentage of the second predetermined threshold, and initiating activation of the heater unit at the first power level in response to determining the calculated remaining drying time at 460 is within the programmed percentage of the second predetermined threshold. Optionally, if the calculated remaining drying time is above the second predetermined time threshold, the controller may activate the heating unit at a second power level higher than the first power level. As such, the heating unit produces a higher level of heat at the second power level than the first power level. In some such embodiments, 470 includes determining the calculated remaining drying time at 460 is greater than the second predetermined time threshold, and initiating activation of the heating unit at the second power level in response to determining the calculated drying time at 460 is greater than the second predetermined time threshold.

At 480, the method 400 includes initiating the fan to circulate air over the heating unit. Thus, 480 may direct the fan to rotate for generation of an air flow, as described above. Optionally, 480 may be in response to calculating the remaining drying time. For example, the fan may be activated at a first rotational speed upon (e.g., in response to) determining that the calculated remaining drying time is at the second predetermined time threshold. The controller may also initiate the fan to operate at a second rotational speed higher than the first rotational speed in response to the calculated remaining drying time being above the second predetermined time threshold. Thus, more airflow at a higher temperature may be circulated through the wash chamber. Additionally or alternatively, in response to the calculated remaining drying time being below the second predetermined threshold, the controller may deactivate the heating unit. Further, the controller may initiate the fan at the first rotational speed in response to the calculated remaining drying time being below the second predetermined threshold.

Still further, the controller may increase the calculated remaining drying time by a predetermined factor. For instance, in response to the calculated remaining drying time being below the second predetermined threshold and the controller initiating the fan at the first rotational speed, the controller may increase the calculated remaining drying time to equal the second predetermined threshold. In other words, the controller may continually control a rotational speed of the fan in order to have the dishes dry by the second predetermined threshold. Thus, the entire drying cycle could be implemented without the use of the heating unit.

At 490, the method 400 includes halting the drying cycle in response to expiration of the drying time. Thus, at the conclusion of the drying time, the controller may halt the drying cycle. For instance, the controller may deactivate the heating unit and halt a rotation of the fan. At this time, the drying cycle may be over, and the dishes may be deemed to be dry. In some embodiments, a user may be alerted that the drying cycle has completed (e.g., as directed by an audio or visual alert signal transmitted to the user interface of the dishwasher).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher, comprising:

a tub defining a wash chamber;

a wash rack provided within the wash chamber;

an air inlet in fluid communication with the wash chamber at a first position;

an air exhaust outlet in fluid communication with the wash chamber at a second position different from the first position;

a first gas sensor provided in the dishwasher; and a controller configured to initiate an operation sequence, the operation sequence comprising:

initiating a drying cycle, receiving an air-quality signal from the first gas sensor, measuring, during the drying cycle, an air-quality characteristic within the wash chamber of the dishwasher, the air-quality characteristic being unrelated to a humidity within the wash chamber, determining the measured air-quality characteristic is below a predetermined air-quality threshold, calculating a drying time in response to determining the measured air-quality characteristic is below the predetermined air-quality threshold, and halting the drying cycle in response to an expiration of the drying time.

2. The dishwasher of claim 1, wherein the operation sequence further comprises:

measuring an elapsed time between the initiation of the drying cycle and the determination that the air-quality characteristic drops below the predetermined air-quality threshold; and calculating the drying time based on the elapsed time.

3. The dishwasher of claim 2, wherein the measuring the air-quality characteristic comprises measuring total volatile organic compounds (tVOC) or equivalent $CO_2$ ($eCO_2$) at the first gas sensor.

4. The dishwasher of claim 3, wherein the first gas sensor is provided at the air exhaust outlet of the dishwasher.

5. The dishwasher of claim 4, further comprising a second gas sensor provided outside of the dishwasher, and wherein the operation sequence further comprises measuring an ambient air-quality characteristic outside of the dishwasher.

6. The dishwasher of claim 1, further comprising a heating unit mounted at the air inlet and a fan provided upstream from the heating unit, wherein during the drying cycle, the operation sequence further comprises:

activating the heating unit at a first power level; and initiating the fan to circulate air over the heating unit and into the dishwasher.

7. The dishwasher of claim 6, wherein the operation sequence further comprises:

determining the calculated dry time is less than a predetermined time threshold;

deactivating the heating unit in response to determining the calculated drying time is less than a predetermined time threshold; and increasing the calculated drying time by a predetermined factor in response to determining the calculated drying time is less than a predetermined time threshold.

8. The dishwasher of claim 6, wherein the operation sequence further comprises:

determining the calculated dry time is greater than or equal to a predetermined time threshold; and activating the heating unit at a second power level greater than the first power level in response to determining the calculated drying time is greater than a predetermined time threshold.

9. The dishwasher of claim 1, wherein air-quality characteristic is total volatile organic compounds (tVOC), and wherein predetermined air-quality threshold is 5 parts per billion (ppb).

* * * * *